United States Patent [19]

Ohishi et al.

[11] Patent Number: 4,609,799

[45] Date of Patent: Sep. 2, 1986

[54] CIRCUIT INTERRUPTER

[75] Inventors: Hirotoshi Ohishi, Fukuyama; Hiroshi Fujii, Asakuchi; Hiroaki Fujihisa, Fukuyama, all of Japan

[73] Assignee: Mitsubishi Denki Kabushiki Kaisha, Tokyo, Japan

[21] Appl. No.: 689,435

[22] Filed: Jan. 7, 1985

[30] Foreign Application Priority Data

| | | | |
|---|---|---|---|
| Jan. 13, 1984 | [JP] | Japan | 59-5070 |
| Jan. 13, 1984 | [JP] | Japan | 59-5071 |
| Jan. 19, 1984 | [JP] | Japan | 59-8333 |
| Jan. 19, 1984 | [JP] | Japan | 59-8334 |

[51] Int. Cl.[4] ..... H01H 9/20

[52] U.S. Cl. ..... 200/153 G; 200/318; 200/323; 335/21

[58] Field of Search ..... 200/153 G, 318–326; 335/21, 23, 35, 175

[56] References Cited

U.S. PATENT DOCUMENTS

| | | | |
|---|---|---|---|
| 3,110,792 | 11/1963 | Gauthier | 200/319 X |
| 3,134,879 | 5/1964 | Gauthier et al. | 200/325 X |
| 3,286,067 | 11/1966 | Menickella | 200/153 G |
| 3,299,244 | 1/1967 | Strobel et al. | 200/318 |
| 3,562,469 | 2/1967 | Peck | 200/318 |

FOREIGN PATENT DOCUMENTS

| | | | |
|---|---|---|---|
| 1904731 | 9/1973 | Fed. Rep. of Germany . | |
| 2084403 | 4/1982 | United Kingdom | 200/318 |

*Primary Examiner*—Stephen Marcus
*Assistant Examiner*—Ernest G. Cusick
*Attorney, Agent, or Firm*—Leydig, Voit & Mayer, Ltd.

[57] ABSTRACT

A circuit interrupter comprises a pair of separable contacts at least one of which is movable, and an operating mechanism operatively connected to the movable contacts for opening and closing the contacts. The operating mechanism includes a movable contact arm having mounted thereon the movable contact, a latch lever pivotally mounted on the movable contact arm, and a toggle link mechanism connected at its one end to an operating handle and the other end of which is directly engageable with said movable contact arm and the latch lever. The movable contact arm has a latch surface, and the latch lever has a latching end which, in cooperation with the latch surface, releasably catches the other end of the toggle link mechanism. A roller may be mounted on the other end of the second toggle link for quick and smooth operation of the operating mechanism.

7 Claims, 7 Drawing Figures

CIRCUIT INTERRUPTER

BACKGROUND OF THE INVENTION

This invention relates to circuit interrupters and more particularly to improvements in an operating mechanism of a circuit interrupter.

West German Pat. No. 19 04 731 discloses an electric circuit interrupter in which a movable contact arm having a movable contact is pivoted for opening and closing the circuit interrupter, on the movable contact arm there is pivotally mounted a releasable member for releasing the movable contact from a latched state the releasable member held a latch member, by an electromagnetic trip device and/or a bimetallic thermal trip device including a bimetallic element operable reponsive to heat. The latch member is pivoted on the movable contact arm and includes one end being in latching engagement with the releasable member, and another end thereof is pivotally connected to one end of a toggle mechanism. The other end of the toggle mechanism is pivotally connected to a manually operable operating handle.

When an overcurrent flows through the circuit interrupter, the bimetallic element is heated to deflect to such an extent that the free end of the bimetallic element pushes and rotates the releasable member which in turn releases the latch member from its latching position. As a result, the movable contact arm is pivoted to open the circuit interrupter. When a massive overload current much greater than the first overcurrent flows through the circuit interrupter, in addition to the above-described opening operation due to the deflection of the bimetallic element, the electromagnetic trip device generates an electromagnetic force which actuates a magnetic plunger to push and rotate the releasable member which in turn will also pull and rotate the latching member from its latching position and cause the movable contact arm to pivot to open the contact of the circuit interrupter to open. When it is desired to manually operate the circuit interrupter, the operating handle of the interrupter is moved. When the handle is operated, the toggle mechanism bridging between the handle and the latch member transmits the handle movement to the latch member and to the movable contact arm to pivot and open the contact of the circuit interrupter.

The operation of this circuit interrupter is quite satisfactory. However, it is desirable to provide a circuit interrupter having an operating mechanism simpler in structure.

SUMMARY OF THE INVENTION

Accordingly, an object of the present invention is to provide a circuit interrupter which is simple in structure.

Another object of the present invention is to provide a circuit interrupter exhibiting a superior interrupting capability.

Another object of the present invention is to provide a circuit interrupter which is easy to manufacture.

Still another object of the present invention is to provide a circuit interrupter which is reliable in operation.

A further object of the present invention is to provide a circuit interrupter less expensive than a circuit interrupter of a conventional design.

With the above object in view, the present invention resides in a circuit interrupter comprising a pair of separable contacts at least one of which is movable and an operating mechanism operatively connected to the contacts for opening and closing the contacts, the operating mechanism including a movable contact arm having mounted thereon the movable contact, a latch lever pivotally mounted on the movable contact arm, and a toggle link mechanism connected at its one end to an operating handle and the other end of which is engageable with the movable contact arm and the latch lever.

BRIEF DESCRIPTION OF THE DRAWINGS

The present invention will become more readily apparent from the following detailed description of the preferred embodiments of the invention taken in conjunction with the accompanying drawings, in which.

DESCRIPTION OF THE PREFERRED EMBODIMENTS

Figure 1:
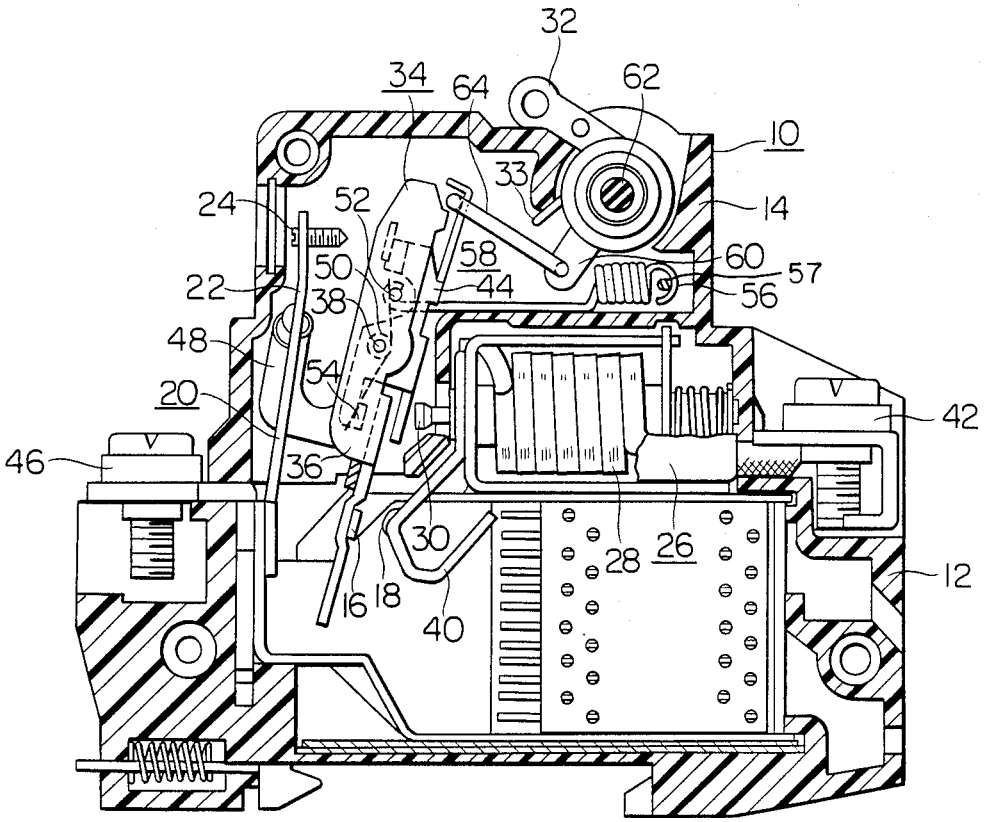
FIG. 1 is a vertical sectional view of one embodiment of a circuit interrupter of the present invention, the circuit interrupter being in the open position.

FIG. 1 shows a circuit interrupter constructed according to the present invention. The circuit interrupter comprises a molded housing 10 formed of a base 12 and a cover 14 each made of an electrically insulating material such as plastic. Within the housing 10, a pair of separable contacts 16 and 18, a bimetallic thermal trip device 20 including a bimetallic element 22 and an adjusting screw 24, an electromagnetic trip device 26 including an electromagnetic coil 28 and a plunger 30, an operating handle 32 biased by a torsion spring 33 in the counterclockwise direction in the figure, and an operating mechanism 34 having a movable contact are 36 are disposed.

Contact 16 of the contact pair 16 and 18 is a movable contact, and the other contact 18 is a stationary contact. The movable contact 16 is carried on by an end of the movable contact arm 36 pivotally mounted in the housing 10 by a pivot pin 38 so that the pivotal movement of the movable contact arm 36 about the pin 38 causes the movable contact 16 to engage or separate from the stationary contact 18. The stationary contact 18 is supported by a rigid conductor 40 connected to a source side terminal 42 through the coil 28 of the electromagnetic trip device 26 including the plunger 30 which projects from the coil 28 to push a latch member 44 mounted on the movable contact arm 36. The movable contact 16 is conneted to a load side terminal 46 through a flexible conductor 48 connected to the contact arm 36 and through the bimetallic element 22 of the thermal trip device 20. Thus, when the contacts 16 and 18 are in contact, an electric current path is provided from the source side terminal 42 to the load side terminal 46 through the coil 28, the rigid conductor 40, the stationary contact 18, the movable contact 16, the movable contact arm 36, the flexible conductor 48, and through the bimetallic element 22.

In accordance with an aspect of the present invention, the movable contact arm 36 of the operating mechanism 34 and the latch member 44 are pivotally supported by the pin 38 fixed on the side walls of the housing 10 and pivotable relative to each other. The pin 38 is wound by a torsion spring 50 which engages at one end thereof with a pin 52 secured on the movable contact arm 36 and at the other end thereof with an extension 54 of the latch member 44. As shown in FIG. 1, the torsion spring 50 biases the latch member 44 to rotate counterclockwise about the pin 38 with respect to the contact arm 36. The movable contact arm 36 is biased to rotate clockwise as viewed in FIG. 1 by a tension spring 56 mounted between the pin 52 and a pin 37 on the side wall of the housing 10. The operating mechanism 34 further comprises a toggle link mechanism 58 including a first toggle link 60 rigidly and integrally connected at one end to the operating handle 32 which is rotatable about its rotary axis 62 and a second U-shaped toggle link 64 (see FIG. 4) having a first leg or end 66 pivotally connected to the other end of the first toggle link 60. As further seen in FIG. 4, the other latch end 68 of the second toggle link 64 is positioned between "jaws" of the movable contact arm 36 and the latch member 44. Thus, in sofar as the other end 68 of the second toggle link 64 is rotatable and caught between the "jaws" of the movable contact arm 36 and the latch member 44, this end 68 of the toggle link mechanism 34 held by the "jaws" may be said to be connected to the movable contact arm 36 and the latch member 44.

Figure 4:
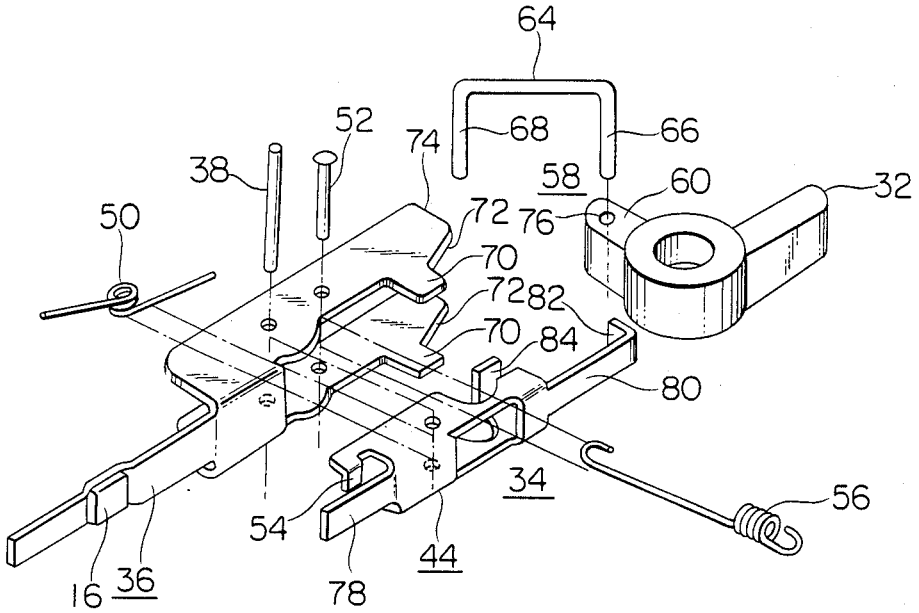
FIG. 4 is an exploded perspective view of the operating mechanism of the circuit interrupter shown in FIGS. 1 to 3.

As is best seen from FIG. 4, in which the components constituting the operating mechanism 34 are illustrated in an exploded perspective view, the movable contact arm 36 is a member made of a bent metallic sheet material including a portion supporting the movable contact 16 and a pair of spaced parallel portions between which the latch member 44 is received. Each of the ends of the parallel portions has formed thereon a stop 70 projecting toward the latch member 44 for engagement with the latch member 44, a latch surface 72 for latching in cooperation with the end of the latch member 44, the latch end 68 of the toggle link 64 of the toggle link mechanism 58, and a guide surface 74 for supporting and guiding the latch end 68 of the toggle link 64 of the toggle link mechanism 58.

When assembled, the first end 66 of the second toggle link 64 is rotatably held in a hole 76 formed in the first toggle link 60 which is an integral portion of the operating handle 32, and the second latch end 68 is placed against the latch surface 72 of the movable contact arm 36.

The latch member 44 also is a bent metallic sheet member adapted to be received between the pair of spaced parallel portions of the contact arm 36. The latch member 44 has a tongue 78 at which the plunger 30 of the electromagnetic trip device 26 makes contact when activated, an elongated L-shaped latch 80 including a bent tip 82, and a tab 84 adapted to be pushed by the adjusting screw 24 of the bimetallic trip device 20. In the assembled state shown in FIG. 1, the latch member 44 is biased by the torsion spring 50, which engages the pin 52 on the contact arm 36 and the extension 54 of the latch member 44, and the elongated latch 80 is pressed against the stops 70 of the movable contact arm 36. It is to be noted that the bent end 82 of the latch member 44, the strength of the torsion spring 50, and the configuration of the latch face 72 are so selected that the second latch end 68 of the second toggle link 64 is caught between the bent end 82 of the latch member 44 and the edges 70 and 72 of the movable contact arm 36 when the circuit interrupter is in the closed position as shown in FIG. 2.

Figure 2:
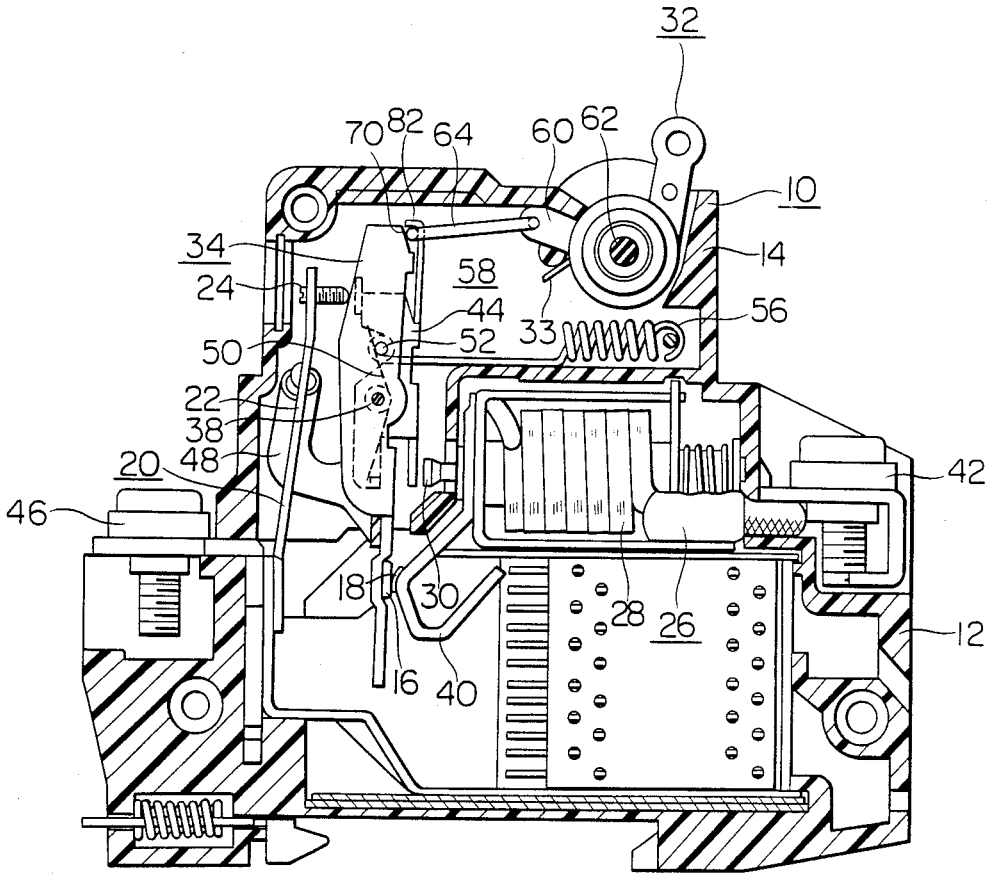
FIG. 2 is a vertical sectional view of the circuit interrupter shown in FIG. 1, the circuit interrupter being in the closed position.

In operation, the circuit interrupter may be manually brought into a closed position as shown in FIG. 2 by turning the operating handle 32 into the ON position shown in FIG. 2. The clockwise rotation of the handle 32 against the action of the spring 56 causes the second latch end 68 of the second toggle link 64 to push the edges 72 of the movable contact arm 36 to rotate the movable contact arm 36 about the pin 38 in the counterclockwise direction against the action of the spring 56, thereby causing the movable contact 16 to engage with the stationary contact 18 as shown in FIG. 2. During this movement of the movable contact arm 36, a toggle knee point, which is on the first end 66 of the second toggle link 64 pivotally inserted into the first toggle link element 60 on the handle 32, moves across the center of action of the toggle link mechanism 58 and the toggle knee point, i.e., the first end 66 of the second link 64 is pushed against the top wall of the cover 14 of the housing 10, and the toggle mechanism 58 and therefore the operating mechanism 34 are thereby in this closed position.

Figure 3:
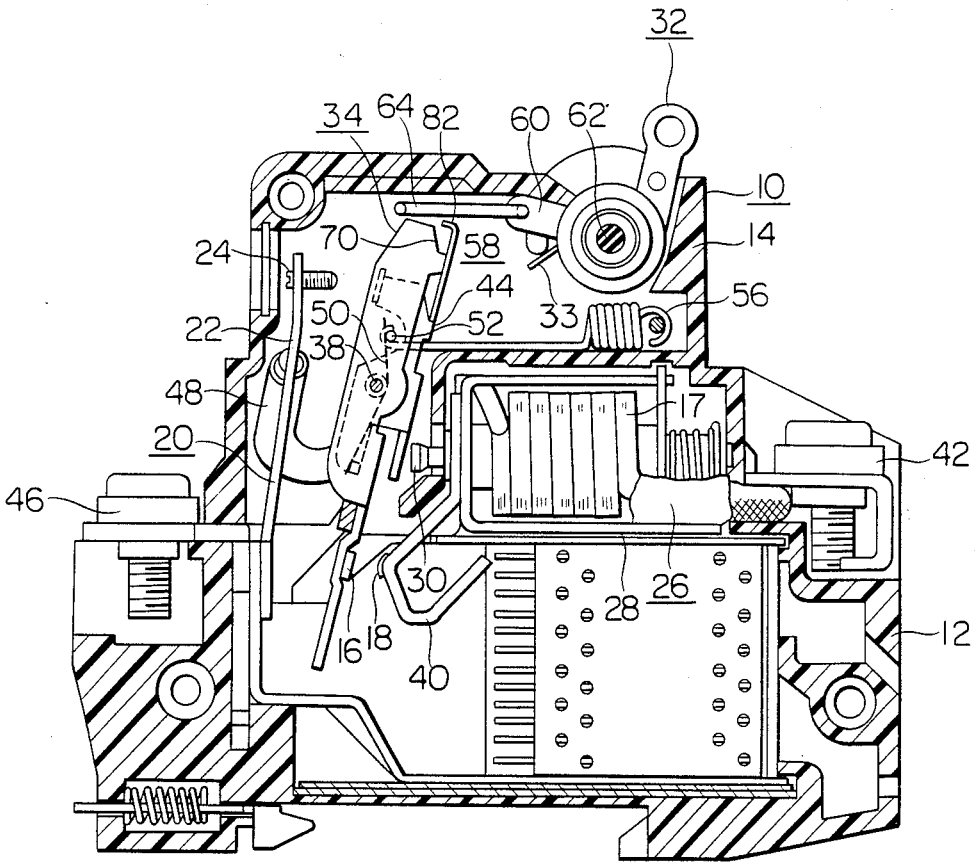
FIG. 3 is a vertical sectional view of the circuit interrupter shown in FIG. 1, the circuit interrupter being in the state immediately after being tripped open.

When an overcurrent of a relatively low level flows through the circuit interrupter in the contact closed position, the thermal trip device 20 is actuated to push the tab 84 on the latch member 44 against the action of the torsion spring 50 to rotate the latch member 44 clockwise relative to the movable contact arm 36. This rotation of the latch member 44 causes the "jaw" of the latch mechanism 34 or the engaging surfaces 70, 72 of the contact arm 36 and the bent latch end 82 of the latch member 44 to open and release the second end 68 of the second toggle link element 64. Therefore, the toggle link second latch end 68 is allowed to slip out from the "jaw" to allow the movable contact arm 36 to be released under the action of the tension spring 56 which causes the clockwise rotation of the movable contact arm 36 and the latch member 44 due to the spring 56, whereby the movable contact 16 separates from the stationary contact 18 as illustrated in FIG. 3 to interrupt the overcurrent. Immediately after the toggle link 64 is released and the contacts 16 and 18 are opened as shown in FIG. 3, the operating handle 32 rotates counterclockwise due to the torsion spring 33. This rotation of the handle 32 causes the second end 68 of the toggle link 64 to be inserted into the "jaw" or the space between the engaging surfaces 70 and 72 of the movable contact arm 36 and the bent end portion 82 of the latch member 44, thus returning to the contact open position shown in FIG. 1.

When a very severe overcurrent flows through the circuit interrupter in the closed position shown in FIG. 2, the plunger 30 of the electromagnetic trip device 26 instantaneously projects from the coil 28 due to the electromagnetic force generated by the overcurrent. The plunger 30 thus pushes the tongue 78 of the latch member 44 to rotate the latch member 44 clockwise about the pin 38 with respect to the movable contact arm 36 against the action of the torsion spring 50. This clockwise rotation of the latch member 44 causes the operating mechanism 34 of the circuit interrupter to achieve the same trip operation as discussed above in conjunction with the relatively low overcurrent condition to interrupt the current flowing through the circuit interrupter.

Figure 5:
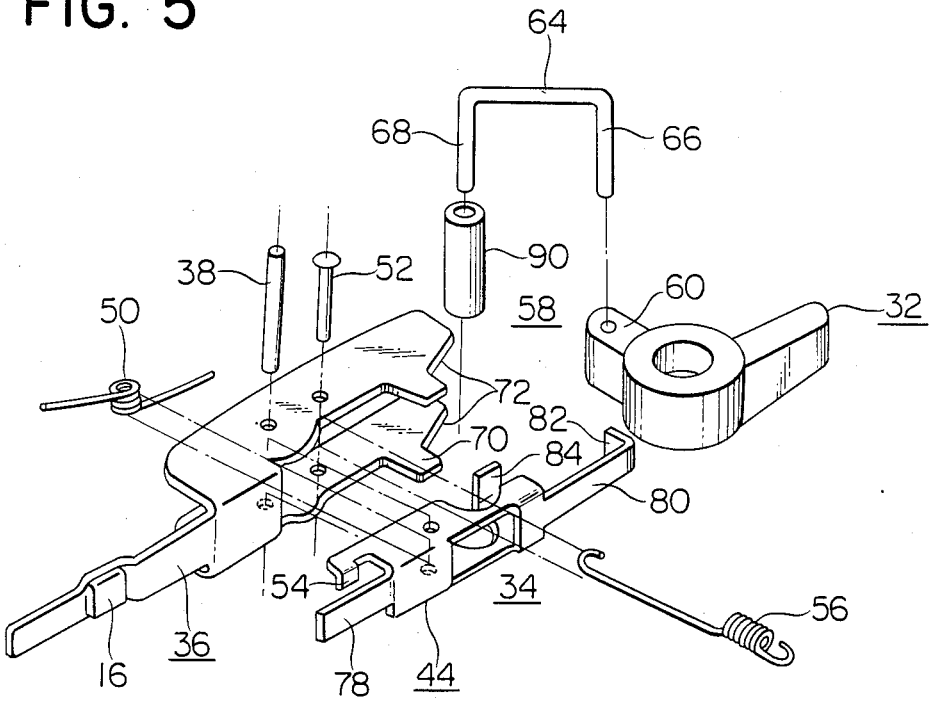
FIG. 5 is an exploded perspective view of the operating mechanism of another embodiment of the present invention.

FIG. 5 illustrates another embodiment of the operating mechanism of the circuit interrupter of the present invention. In this embodiment, it is to be noted that a roller 90 is rotatably mounted on the second end 68 of the second toggle link 64 of the toggle link mechanism 58. In other respects, the structure is the same as that described above in conjunction with the embodiment shown in FIGS. 1 to 4. The outer surface of the roller 90 engages with the bent end portion 82 of the latch member 44 as well as the engaging surfaces 70 and 72 of the movable contact arm 36. According to this embodiment, since the roller 90 is provided on the second end 68 which engages and slides on the bent end 82 of the latch member 44 and the engaging surfaces 70 and 72, the second end 68 can smoothly and more quickly slide on the surfaces 70 and 72 to be more quickly and reliably released from the "jaw" when the operating mechanism 34 is tripped open.

Figure 6:
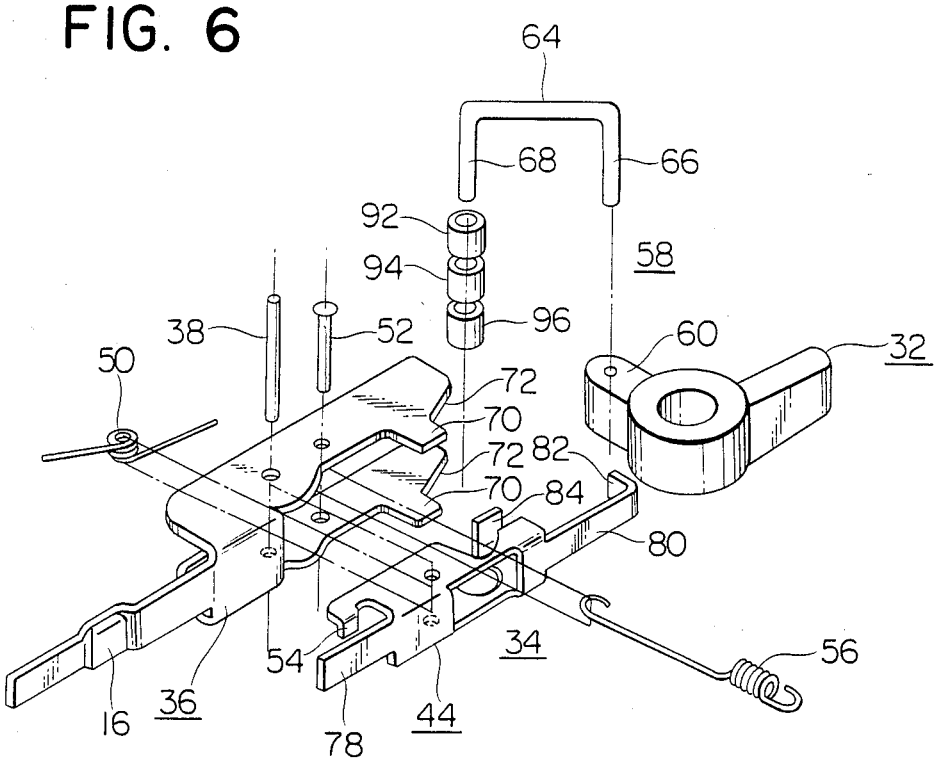
FIG. 6 is an exploded perspective view of the operating mechanism of another embodiment of the present invention.

FIG. 6 illustrates another modification of the operating mechanism of the circuit interrupter of the present invention. It is seen that the second end 68 of the second toggle link 64 is provided with three rollers 92, 94 and 96 which are independently rotatable on the second end 68 of the toggle link 64. The end rollers 92 and 96 (the upper and lower rollers in FIG. 6) engage the engaging surfaces 70 and 72, respectively, of the upper and the lower plate sections (as viewed in FIG. 7) of the movable contact arm 36, respectively. Since the bent end portion 82 is narrower than the distance between the upper and the lower plate sections, it does not engage rollers 92 or 96. The central roller 94 engages the bent end portion 82 of the latch member 44, and it does not engage with the engaging surfaces 70 and 72. When the second end 68 of the toggle link 64 is to be released from the space between the movable contact arm 36 and the latch member 44, the three rollers 92, 94, and 96 are rotated in opposite directions independently of each other according to the side of the rollers on which the engaging surfaces 70 and 72 and the bent end portion 82 engage. Thus, three rollers 92, 94 and 96 allow still quicker, smoother, and more reliable tripping operation of the operating mechanism.

Figure 7:
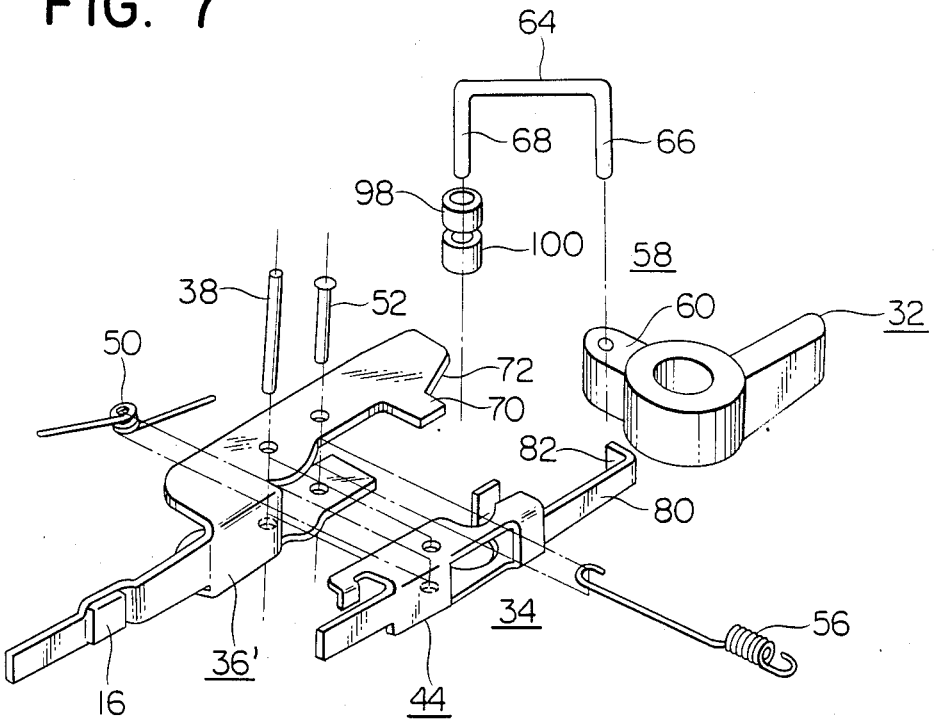
FIG. 7 is an exploded perspective view of the operating mechanism of still another embodiment of the present invention.

FIG. 7 illustrates still another embodiment of the operating mechanism 34 in which the second end 68 of the second toggle link 64 is provided with two rollers 98 and 100 independently rotatable on the second end 68. It is also seen that the movable contact arm 36' has only one plate section and only one set of engaging surfaces 70 and 72 with which the second end 68 of the toggle link 64 engages. Thus, the roller 98 (the upper roller in FIG. 7) engages the movable contact arm 36' at the engaging surfaces 70 and 72, while the roller 100 (the lower roller in FIG. 7) engages the bent end portion 82 of the latch member 44. This arrangement is simpler in construction and is still quicker and more reliable in operation.

What is claimed is:

1. A circuit interrupter comprising:

a pair of separable contacts, at least one of which is movable;

an operating handle for manually operating said interrupter; and an operating mechanism operatively connected to move said movable contact relative to the other contact for opening and closing said circuit interrupter, said operating mechanism including:

a movable contact arm carrying said movable contact at one end and providing a latch surface at the other end, a latch member pivotally mounted on said movable contact arm and having a latching end spaced from said latch surface to form a jaw therebetween, and a toggle link mechanism connected to said operating handle and having a portion adapted to be received in and held by engagement with the spaced latching end and latch surface forming said jaw to form a connection with said latch member to operate said movable contact arm to manually open and close said contacts of said interrupter, said portion of said toggle link means being released from said jaw by coaction with said latch surface upon movement of said latching end of said latch member away from said latch surface to open said jaw caused by said operating mechanism to trip said interrupter.

2. A circuit interrupter as claimed in claim 1 wherein said toggle link mechanism comprises a first link rigidly connected to said operating handle, a second link having one end pivotally connected to said first link, and roller means rotatably mounted on the other end of said second link and adapted to be received and held in engagement in said jaw with said latch member with the separable contacts in contact, said roller means being slidably releasable from said jaw to separate the contacts to open the interrupter.

3. A circuit interrupter as claimed in claim 2 wherein said second link comprises a substantially U-shaped rod having an end leg slidably and rotatably engaged with said roller means.

4. A circuit interrupter comprising:

a pair of separable contacts, at least one of which is movable;

an operating handle for manually operating said interrupter; and an operating mechanism operatively connected to move said movable contact relative to the other contact for opening and closing said circuit interrupter, said operating mechanism including:

a movable contact arm carrying said movable contact at one end and providing a latch surface at the other end, a latch member pivotally mounted on said movable contact arm and having a latching end spaced from said latch surface to form a jaw therebetween, and a toggle link means including a first link rigidly connected to said operating handle, a second link having one end pivotally connected to said first link, and roller means rotatably mounted on the other end of said second link and adapted to be received and held by engagement with said latching end and said latching surface to operate said movable contact arm to manually open and close said contacts of said interrupter, said roller means being slidably released from said jaw by coaction with said latch surface upon movement of said latching end away from said latch surface caused by said operating mechanism to trip said interrupter.

5. A circuit interrupter comprising:

a pair of separable contacts, at least one of which is movable;

an operating handle for manually operating said interrupter; and an operating mechanism operatively connected to move said movable contact relative to the other contact for opening and closing said circuit interrupter, said operating mechanism including:

a movable contact arm carrying said movable contact at one end and providing a apir of spaced parallel latch surfaces at the other hand;

a latch member pivotally mounted on said movable contact arm and having a latching end spaced from said latch surface to form a jaw therebetween, and a toggle link means including a first link rigidly connected to said operating handle, a second link having one end pivotally connected to said first link, and roller means including three independently rotatable rollers rotatably mounted on the other end of said second link, two of said rollers being adapted to be received and held by engagement with said latch surfaces while the other roller being adapted to be received and held by engagement with said latching end to operate said movable contact arm to manually open and close said contacts of said interrupter and being slidably released from said jaw by coaction with said latch surfaces upon movement of said latching end away from said latch surface caused by said operating mechanism to trip said interrupter.

6. A circuit interrupter comprising:

a pair of separable contacts, at lest one of which is movable;

an operating handle for manually operating said interrupter; and an operating mechanism operatively connected to move said movable contact relative to the other contact for opening and closing said circuit interrupter, said operating mechanism including:

a movable contact arm carrying said movable contact at one end and a single latch surface at the other end, a latch member pivotally mounted on said movable contact arm and having a latching end spaced from said latch surface to form a jaw therebetween; and a toggle link means connected to said operating handle and latching said latch member to operate said movable contact arm to manually open said interrupter, and being released from said latch member to separate the separable contacts upon a tripping operation of said interrupter, said toggle link mechanism comprising a first link rigidly connected to said operating handle, a second link having one end pivotally connected to said first link, and roller means including a pair of rollers independently rotatably mounted on the other end of said second link and respectively received and held by engagement in said jaw with said latch surface of said contact arm and said latching end of said latch member to operate said movable contact arm to manually open and close said contacts of said interrupter, said roller means being slidably released from said jaw by coaction with said latch surface upon movement of said latching end away from said latch surface caused by said operating mechanism to trip said interrupter.

7. A circuit interrupter comprising:

a pair of separable contacts, at least one of which is movable;

an operating handle for manually operating said interrupter; and an operating mechanism operatively connected to move said movable contact relative to the other contact for opening and closing said circuit interrupter, said operating mechanism including:

a latch member pivotally mounted on said movable contact arm and forming a jaw therebetween, and a toggle link means connected to said operating handle and having a portion adapted to be received in said jaw to form a connection with said latch member to operate said movable contact arm to manually open and close said contacts of said interrupter, said portion of said toggle link means being released from said jaw by coaction with said latch surface upon movement of said latch member to open said jaw caused by said operating mechanism to trip said interrupter.

* * * * *